US005499742A

United States Patent [19]

Ives, Sr.

[11] Patent Number: 5,499,742

[45] Date of Patent: Mar. 19, 1996

[54] RECIPROCATING TOOTHPASTE DISPENSER

[76] Inventor: Kenneth L. Ives, Sr., 101 Loveland Rd., Hebron, Conn. 06248

[21] Appl. No.: 302,174

[22] Filed: Sep. 8, 1994

[51] Int. Cl.[6] ..... B65D 35/34

[52] U.S. Cl. ..... 222/101; 222/105; 222/181.3; 222/183

[58] Field of Search ..... 222/101, 105, 222/181.3, 183

[56] References Cited

U.S. PATENT DOCUMENTS

| | | | |
|---|---|---|---|
| 1,514,018 | 11/1924 | Sharpe | 222/101 |
| 2,530,327 | 11/1950 | Derrick | 222/101 |
| 2,600,553 | 6/1952 | Lord | 222/105 |
| 2,679,951 | 6/1954 | Yantzer | 222/101 |
| 2,830,734 | 4/1958 | Burger | 222/101 |
| 2,936,006 | 5/1960 | Henley | 222/101 |
| 4,019,655 | 4/1977 | Moeller | 222/101 |
| 4,258,864 | 3/1981 | Karamanolis et al. | 222/101 |
| 4,722,457 | 2/1988 | Bedwell et al. | 222/105 |

*Primary Examiner*—Andres Kashnikow
*Assistant Examiner*—Lisa Douglas

[57] ABSTRACT

A dispenser for supporting a tube of toothpaste in an inverted position and progressively collapsing an end of the tube to dispense toothpaste therefrom. The inventive device includes a holding frame securable to a wall surface which receives and supports the toothpaste. A pair of rack members are pivotally mounted within the holding frame and include a plurality of detents which support a roller proximal to the tube. A handle is mechanically coupled to the racks such that reciprocation of the racks through a movement of the handle will bias the roller into engagement with the tube to dispense the toothpaste. The roller is then gravitationally biased into a lower pair of detents to effect continued compression of the tube.

6 Claims, 4 Drawing Sheets

RECIPROCATING TOOTHPASTE DISPENSER

BACKGROUND OF THE INVENTION

1. Field of the Invention

The present invention relates to dispensing structures and more particularly pertains to a reciprocating toothpaste dispenser for supporting a tube of toothpaste in an inverted position and progressively collapsing an end of the tube to dispense toothpaste therefrom.

2. Description of the Prior Art

The use of dispensing structures is known in the prior art. More specifically, dispensing structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art dispensing structures include U.S. Pat. Nos. 5,248,065; 5,215,223; 5,048,725; 4,715,517; and 4,256,242.

While these devices fulfill their respective, particular objectives and requirements, the aforementioned patents do not disclose a dispenser for progressively collapsing an end of a toothpaste tube to dispense toothpaste therefrom which includes a holding frame securable to a wall surface which receives and supports the toothpaste tube, a pair of rack members pivotally mounted within the holding frame and having a plurality of detents which rotatably support a roller proximal to the toothpaste tube, and a handle mechanically coupled to the racks such that reciprocation of the racks through a movement of the handle will bias the roller into engagement with the tube to dispense the toothpaste therefrom.

In these respects, the reciprocating toothpaste dispenser according to the present invention substantially departs from the conventional concepts and designs of the prior art, and in so doing provides an apparatus primarily developed for the purpose of progressively collapsing an end of a tube of toothpaste to dispense the toothpaste therefrom.

SUMMARY OF THE INVENTION

In view of the foregoing disadvantages inherent in the known types of dispensing structures now present in the prior art, the present invention provides a new reciprocating toothpaste dispenser construction wherein the same can be utilized for dispensing toothpaste. As such, the general purpose of the present invention, which will be described subsequently in greater detail, is to provide a new reciprocating toothpaste dispenser apparatus and method which has many of the advantages of the dispensing structures mentioned heretofore and many novel features that result in a reciprocating toothpaste dispenser which is not anticipated, rendered obvious, suggested, or even implied by any of the prior art dispensing structures, either alone or in any combination thereof.

To attain this, the present invention generally comprises a dispenser for supporting a tube of toothpaste in an inverted position and progressively collapsing an end of the tube to dispense toothpaste therefrom. The inventive device includes a holding frame securable to a wall surface which receives and supports the toothpaste. A pair of rack members are pivotally mounted within the holding frame and include a plurality of detents which support a roller proximal to the tube. A handle is mechanically coupled to the racks such that reciprocation of the racks through a movement of the handle will bias the roller into engagement with the tube to dispense the toothpaste. The roller is then gravitationally biased into a lower pair of detents to effect continued compression of the tube.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new reciprocating toothpaste dispenser apparatus and method which has many of the advantages of the dispensing structures mentioned heretofore and many novel features that result in a reciprocating toothpaste dispenser which is not anticipated, rendered obvious, suggested, or even implied by any of the prior art dispensing structures, either alone or in any combination thereof.

It is another object of the present invention to provide a new reciprocating toothpaste dispenser which may be easily and efficiently manufactured and marketed.

It is a further object of the present invention to provide a new reciprocating toothpaste dispenser which is of a durable and reliable construction.

An even further object of the present invention is to provide a new reciprocating toothpaste dispenser which is susceptible of a low cost of manufacture with regard to both materials and labor, and which accordingly is then susceptible of low prices of sale to the consuming public, thereby making such reciprocating toothpaste dispensers economically available to the buying public.

Still yet another object of the present invention is to provide a new reciprocating toothpaste dispenser which provides in the apparatuses and methods of the prior art some of the advantages thereof, while simultaneously overcoming some of the disadvantages normally associated therewith.

Still another object of the present invention is to provide a new reciprocating toothpaste dispenser for supporting a tube of toothpaste in an inverted position and progressively collapsing the tube to dispense toothpaste therefrom.

Yet another object of the present invention is to provide a new reciprocating toothpaste dispenser which includes a holding frame securable to a wall surface which receives and supports the toothpaste tube, a pair of rack members pivotally mounted within the holding frame and having a plurality of detents which rotatably support a roller proximal to the toothpaste tube, and a handle mechanically coupled to the racks such that reciprocation of the racks through a movement of the handle will bias the roller into engagement with the tube to dispense the toothpaste therefrom.

Even still another object of the present invention is to provide a new reciprocating toothpaste dispenser of the aforementioned structure in which the roller is gravitationally biased into a lower pair of detents to effect continued compression of the tube.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
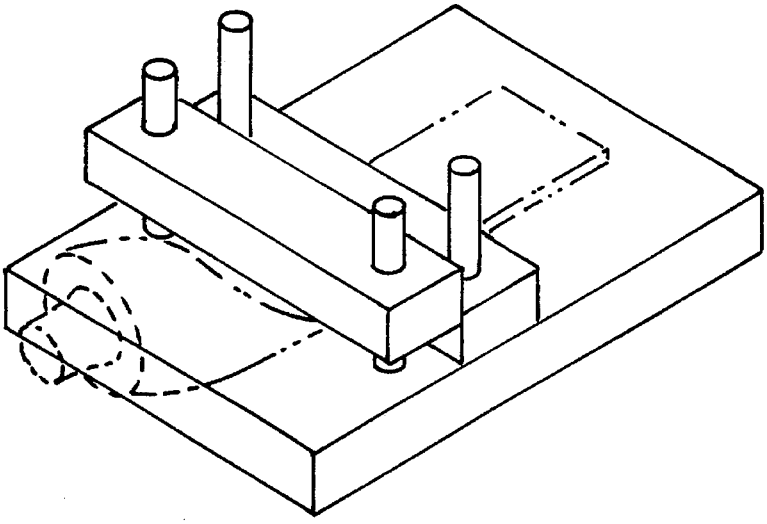
FIG 1 PRIOR ART
FIG. 1 is an isometric illustration of a prior art toothpaste dispensing structure.

With reference now to the drawings, and in particular to FIGS. 1–7 thereof, a new reciprocating toothpaste dispenser embodying the principles and concepts of the present invention and generally designated by the reference numeral 10 will be described.

Figure 2:
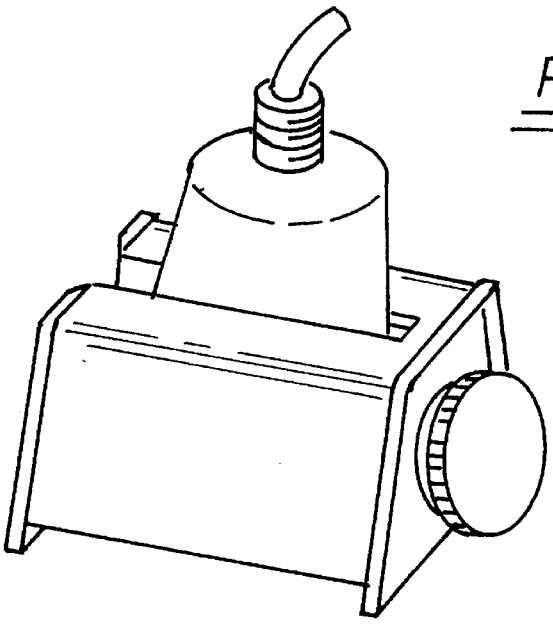
FIG 2 PRIOR ART
FIG. 2 is an isometric illustration of a further prior art dispensing structure.

Referring initially to FIGS. 1 and 2 wherein prior art dispensing structures are illustrated, it can be shown that these devices typically collapse a tube of toothpaste either through a sliding engagement with a compression block, as illustrated in FIG. 1, or through a rotatable engagement of the tube to a spool, as shown in FIG. 2.

Figure 3:
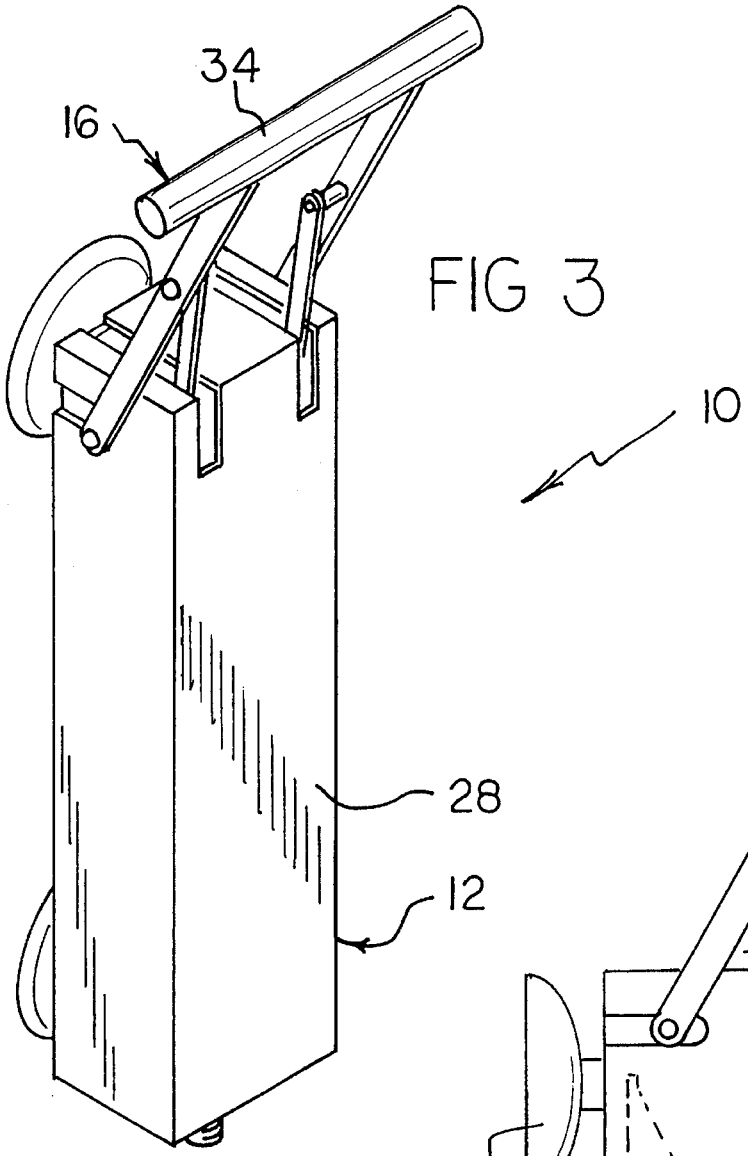
FIG. 3 is an isometric illustration of a reciprocating toothpaste dispenser according to the present invention.
Figure 4:
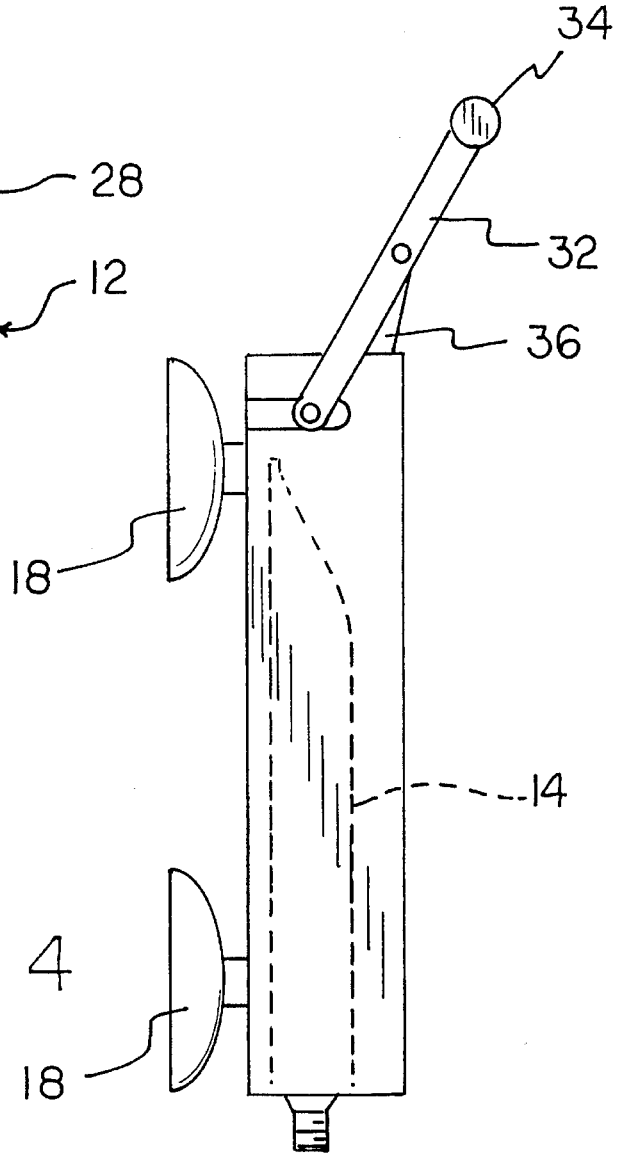
FIG. 4 is a side elevation view thereof.

As shown in FIGS. 3 and 4, the present invention 10 substantially departs from the designs of the prior art. To this end, the reciprocating toothpaste dispenser 10 according to the present invention comprises a frame means 12 for receiving and supporting a toothpaste tube 14 in a substantially vertical orientation, as shown in FIG. 4. A collapsing means 16 extends from an upper end of the frame means 12 and can be selectively operated to effect compression of the toothpaste tube 14 and subsequent dispensing of the toothpaste therefrom. A mounting means in the form of either a pair of suction cups 18 or threaded fasteners secures the frame means 12 to a vertical wall surface, such as a bathroom wall.

Figure 5:
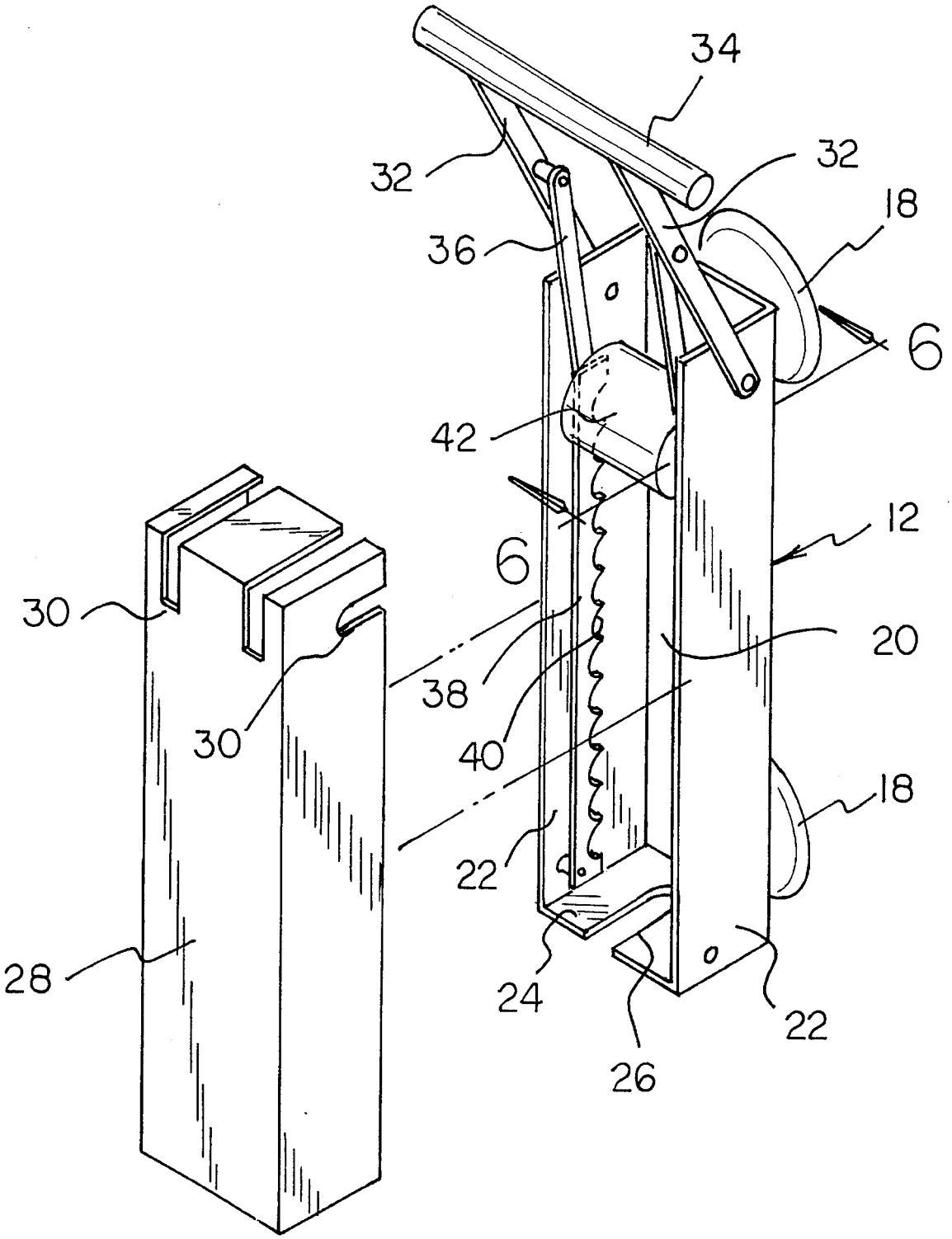
FIG. 5 is an isometric view, partially exploded, of the present invention detailing the interior components thereof.
Figure 6:
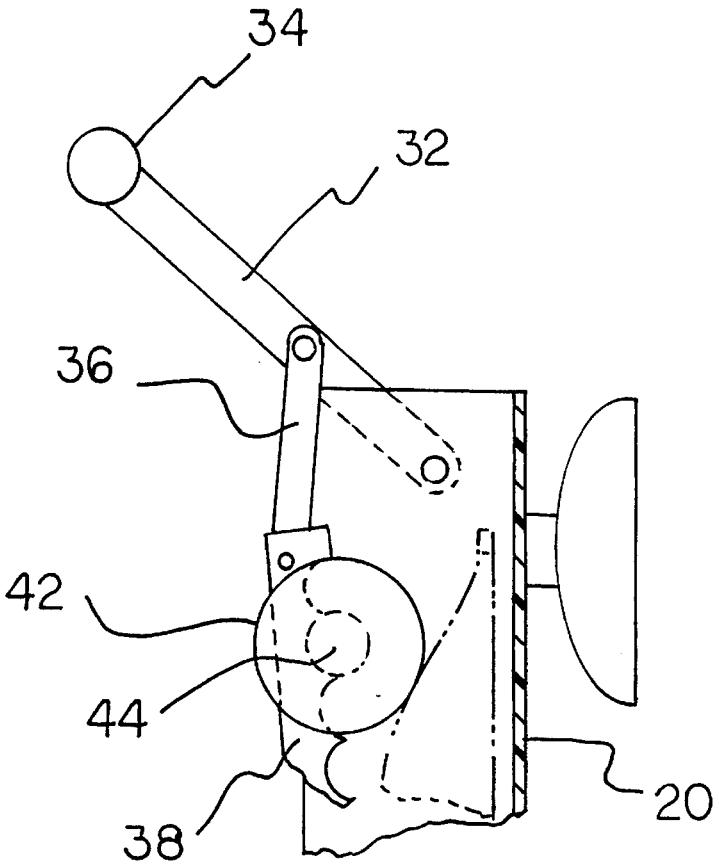
FIG. 6 is a cross-sectional view taken along line 6—6 of FIG. 5 illustrating the handle in a first position.
Figure 7:
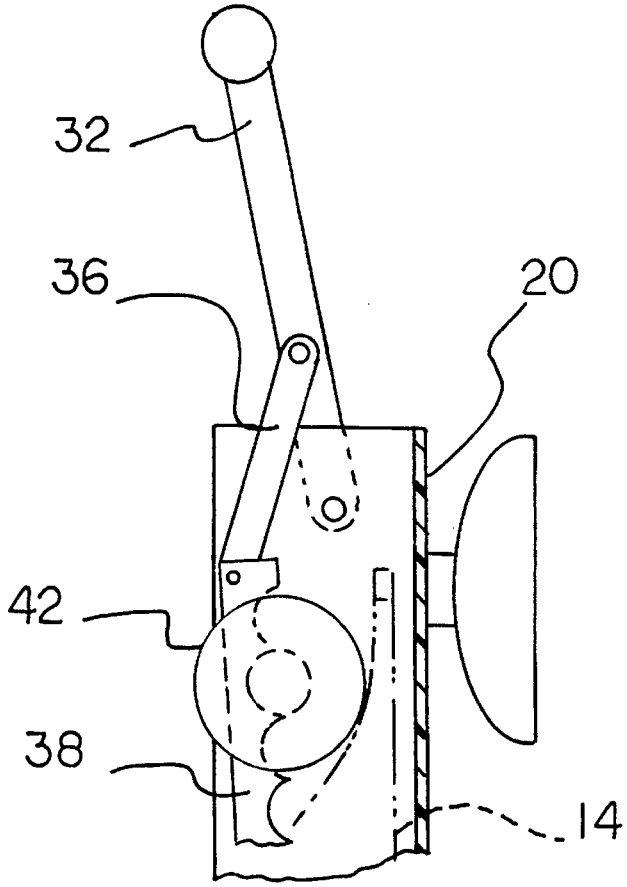
FIG. 7 is a further cross-sectional view illustrating the handle in a second position.

As best illustrated in FIG. 5, the frame means 12 comprises an unlabelled channel member having a substantially planer back wall 20 with a pair of spaced side walls 22 orthogonally projecting therefrom. The side walls 22 extend along a longitudinal length of the back wall 20 and are coupled together by a bottom wall 24 extending therebetween at a lower end thereof. The bottom wall 24 includes an elongated slot 26 directed thereinto which permits a placement of the toothpaste tube 14 into the channel member so as to reside between the side walls 22 with a dispensing neck of the toothpaste tube projecting through the elongated slot 26 and exterior of the frame means 12. A cover 28 having a plurality of cover slots 30 can be slidably and frictionally engaged to the channel member to complete the frame means 12 and fully enclose the toothpaste tube 14 residing therein. The mounting means, preferably comprising the suction cups 18, is mounted to the back wall 20 and can be engaged to a vertical wall surface to support the frame means 12 in a substantially vertical orientation.

To effect progressive collapsing of the toothpaste tube 14 to subsequently dispense the toothpaste contained therein through the dispensing neck of the tube, the collapsing means 16 comprises a pair of spaced handle levers 32 which are pivotally mounted to the side walls 22 and connected together by an orthogonally oriented handle 34. As shown in FIG. 5, a pair of rack levers 36 are pivotally mounted to the handle levers 32 proximal to a center of the longitudinal length of the handle levers and extend downwardly to pivotally connect with a pair of racks 38. Each of the racks 38 is pivotally mounted at a lower end thereof to a respective side wall 22 and includes a plurality of semi-circular detents 40 extending along a longitudinal length thereof. A roller 42 of substantially cylindrical configuration includes a roller axle 44 extending therethrough which can be received and supported within an opposed pair of detents 40 of the respective racks 38. In other words, a first end of the roller axle is received within one of the detents 40 of a first one of the racks 38, with a second end of the roller axle being received within one of the detents 40 of a second one of the racks 38 to support the roller 42 between the pair of racks 38 and against the toothpaste tube 14 when such tube is positioned within the frame means Turning now to FIGS. 6 and 7 wherein an operation of the device is illustrated, it can be shown that the handle 34 of the collapsing means 16 can be moved from a first position illustrated in FIG. 6 to a second position illustrated in FIG. 7. Movement of the handle 34 from the first position to the second position effects pivoting of the rack 38 to bias the roller 42 into engagement with the toothpaste tube 14, thereby compressing the toothpaste tube and forcing the toothpaste contained therein through the dispensing neck of the tube. Movement of the handle 34 from the second position to the first position will then pivot the rack 38 away from the toothpaste tube 14, whereby the roller 42 will be gravitationally biased into a lower pair of opposed detents 40. By this structure, the handle 34 may be selectively reciprocated to effect dispensing of the toothpaste from the toothpaste tube 14.

In use, the reciprocating toothpaste dispenser 10 can be easily installed to a vertical wall of a bathroom structure or the like. A toothpaste tube 14 can then be positioned within the channel member of the frame means 12 with the dispensing neck of the tube projecting through the elongated slot 26 of the bottom wall 24. The roller 42 can then be positioned between the racks 38 and the rack wall 20 so as to engage a closed end of the tube. The cover 28 can be selectively secured to the channel member of the frame means 12 to enclose both the toothpaste tube 14 and the interior components of the collapsing means 16. The device 10 can then be selectively operated through a reciprocation of the handle 34 as described above to effect dispensing of the toothpaste from the tube.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A reciprocating toothpaste dispenser comprising:

a frame means for receiving and supporting a toothpaste tube in a substantially vertical orientation;

a collapsing means extending from an upper end of said frame means for effecting compression of said toothpaste tube and subsequent dispensing of said toothpaste therefrom;

a mounting means coupled to said frame means for supporting said frame means relative to a vertical wall surface;

wherein said frame means comprises a channel member having a substantially planer back wall with a pair of spaced side walls orthogonally projecting from said back wall, said side walls being coupled together by a bottom wall extending therebetween at a lower end of said side walls, said bottom wall including an elongated slot directed thereinto which permits a placement of said toothpaste tube into said channel member so as to reside between said side walls with a dispensing neck of said toothpaste tube projecting through said elongated slot and exterior of said frame means;

and further wherein said collapsing means comprises a pair of racks, each of said racks being pivotally mounted at a lower end thereof to an individual one of said side wall, said racks each including a plurality of semi-circular detents extending along a longitudinal length thereof; a roller of substantially cylindrical configuration; a roller axle extending through said roller, said axle being received and supported within an opposed pair of said detents of said racks such that a first end of said roller axle is received within one of said detents of a first one of said racks, and a second end of said roller axle is received within one of said detents of a second one of said racks to support said roller between said pair of racks for engagement against said toothpaste tube; and means to reciprocate said racks relative to said frame means.

2. The reciprocating toothpaste dispenser of claim 1, and further comprising a cover having a plurality of cover slots frictionally engaged to said channel member for enclosing said toothpaste tube within said frame means.

3. The reciprocating toothpaste dispenser of claim 2, wherein said mounting means comprises a pair of suction cups secured to said frame means.

4. A reciprocating toothpaste dispenser comprising:

a frame means for receiving and supporting a toothpaste tube in a substantially vertical orientation, said frame means comprising a channel member having a substantially planer back wall with a pair of spaced side walls orthogonally projecting from said back wall, said side walls being coupled together by a bottom wall extending therebetween at a lower end of said side walls, said bottom wall including an elongated slot directed thereinto which permits a placement of said toothpaste tube into said channel member so as to reside between said side walls with a dispensing neck of said toothpaste tube projecting through said elongated slot and exterior of said frame means;

a collapsing means extending from an upper end of said frame means for effecting compression of said toothpaste tube and subsequent dispensing of said toothpaste therefrom, said collapsing means comprising a pair of racks, each of said racks being pivotally mounted at a lower end thereof to an individual one of said side wall, said racks each including a plurality of semi-circular detents extending along a longitudinal length thereof; a roller of substantially cylindrical configuration; a roller axle extending through said roller, said axle being received and supported within an opposed pair of said detents of said racks such that a first end of said roller axle is received within one of said detents of a first one of said racks, and a second end of said roller axle is received within one of said detents of a second one of said racks to support said roller between said pair of racks for engagement against said toothpaste tube; a pair of spaced handle levers pivotally mounted to said side walls and connected together by an orthogonally oriented handle; a pair of rack levers pivotally mounted to said handle levers proximal to a center of a longitudinal length of said handle levers, said rack levers extending downwardly to pivotally connect with said pair of racks, whereby a movement of said handle from a first position to a second position effects pivoting of said racks to bias said roller into engagement with said toothpaste tube, thereby compressing said toothpaste tube and forcing toothpaste contained therein through said dispensing neck of said tube, with movement of said handle from said second position to said first position pivots said racks away from said toothpaste tube, whereby said roller will be gravitationally biased into a lower pair of opposed detents;

and, a mounting means coupled to said frame means for supporting said frame means relative to a vertical wall surface.

5. The reciprocating toothpaste dispenser of claim 4, wherein said mounting means comprises a pair of suction cups secured to said frame means.

6. The reciprocating toothpaste dispenser of claim 5, and further comprising a cover having a plurality of cover slots frictionally engaged to said channel member for enclosing said toothpaste tube within said frame means.

* * * * *